United States Patent [19]

Bode, Sr. et al.

[11] 4,368,627

[45] Jan. 18, 1983

[54] MAT OR RUG CLEANING SYSTEM

[76] Inventors: Howard E. Bode, Sr., P.O. Box 9442, Metairie, La. 70055; James B. Williams, 5168 Mt. Revarb, Marrero, La. 70072

[21] Appl. No.: 194,217

[22] Filed: Oct. 6, 1980

Related U.S. Application Data

[62] Division of Ser. No. 879,042, Feb. 21, 1978, Pat. No. 4,226,641.

[51] Int. Cl.[3] ..... D06B 3/22; D06B 23/02

[52] U.S. Cl. ..... 68/13 R; 68/85; 68/175; 68/208

[58] Field of Search ..... 134/9, 10, 16, 60, 63, 134/64 R, 122 R, 26; 15/5, 21 D, 40, 42, 89, 306 A, 308, 309; 8/151; 68/22 R, 31, 44, 62, 85, 99, 13 R, 38, 9, 175, 208

[56] References Cited

U.S. PATENT DOCUMENTS

| | | | |
|---|---|---|---|
| 831,294 | 9/1906 | Olson | 15/40 |
| 1,564,453 | 12/1925 | Shampay | 68/38 X |
| 2,067,752 | 1/1937 | Chase et al. | 68/85 X |
| 2,283,011 | 5/1942 | Mendelson | 68/85 |
| 2,632,197 | 3/1953 | Moss et al. | 15/309 X |
| 2,824,321 | 2/1958 | Bandy | 134/122 R X |
| 3,518,710 | 7/1970 | Heilman | 15/5 |
| 3,772,732 | 11/1973 | Gilmore | 15/5 X |
| 3,857,261 | 12/1974 | Wilcox | 68/208 X |
| 3,864,079 | 2/1975 | Gregg | 68/62 X |
| 4,039,349 | 8/1977 | Kwasnoski et al. | 134/10 |
| 4,095,443 | 6/1978 | Hasselschwert | 68/62 X |
| 4,103,389 | 8/1978 | Resnick et al. | 15/309 X |

FOREIGN PATENT DOCUMENTS

| | | | |
|---|---|---|---|
| 1218099 | 1/1971 | United Kingdom | 15/40 |

*Primary Examiner*—Philip R. Coe

*Attorney, Agent, or Firm*—C. Emmett Pugh & Associates

[57] ABSTRACT

A rug or mat cleaning apparatus is disclosed which is comprised of first a dry lint and dust removing section, then a water or like liquid containing vessel having an initial wash section and then a rinse section and then finally a wringer section. A mat to be cleaned is passed through a first conveying roller at a slower driving speed. Thereafter, the mat or rug enters an increased speed brush which both removes dirt and agitates the surface of the rug and beats it to knock loose undesireable dirt and like particles. In the wash section of the apparatus, alternating feed rollers and brush rollers carry the mat or rug to be cleaned. Each feed roller clamps and holds the rug to prevent slipping while conveying it at a slower linear speed. Each brush roller provides a brushing surface having a substantially higher linear speed than the surface of the conveying rolls. Thus, a "tuck" or crease is created in the rug between each high speed roller brush and its adjacent and following slower conveying roll. A wringer is provided at the end of the apparatus to remove extraneous water from the rug after its cleansing. Pressure belts are provided above the cleaning brushes for enhanced cleaning and operation. A special beater roller with projecting ridges is also included.

12 Claims, 7 Drawing Figures

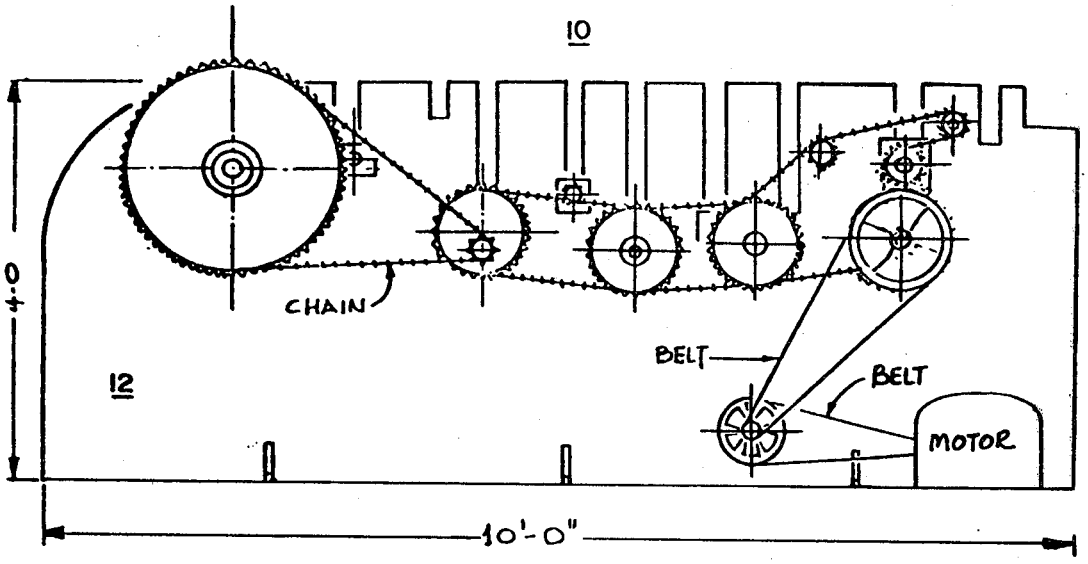
LEFT VIEW FIG. 4
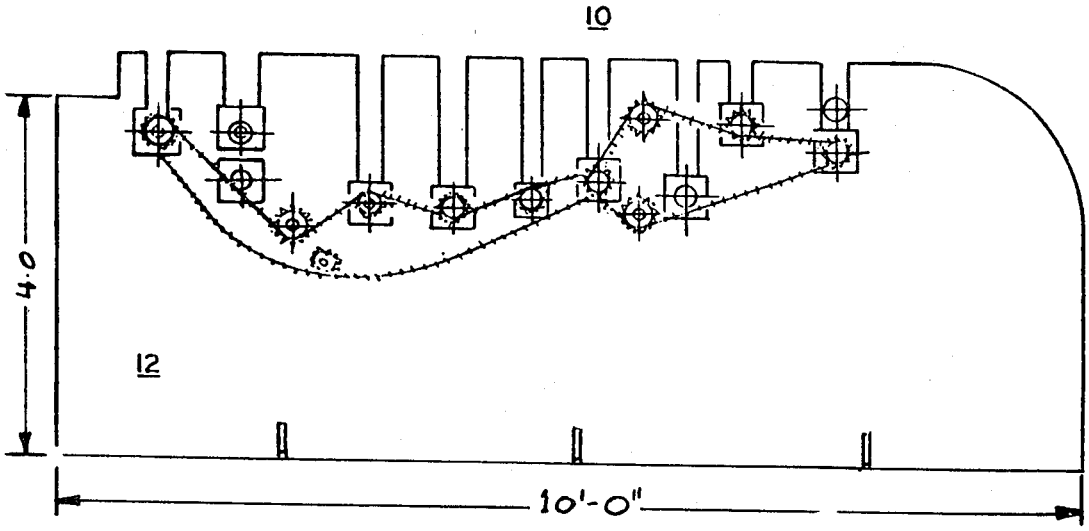
FIG. 5 RIGHT VIEW

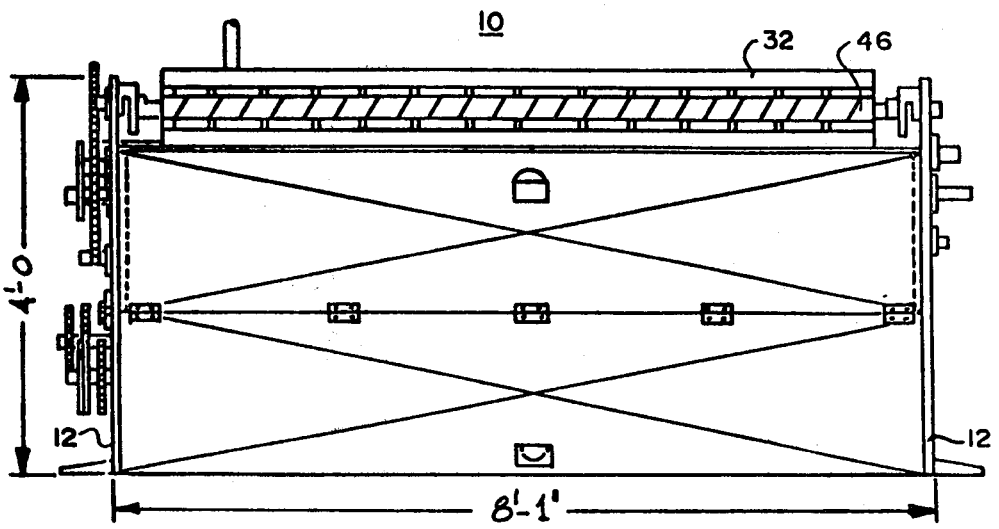
FRONT VIEW FIG. 6
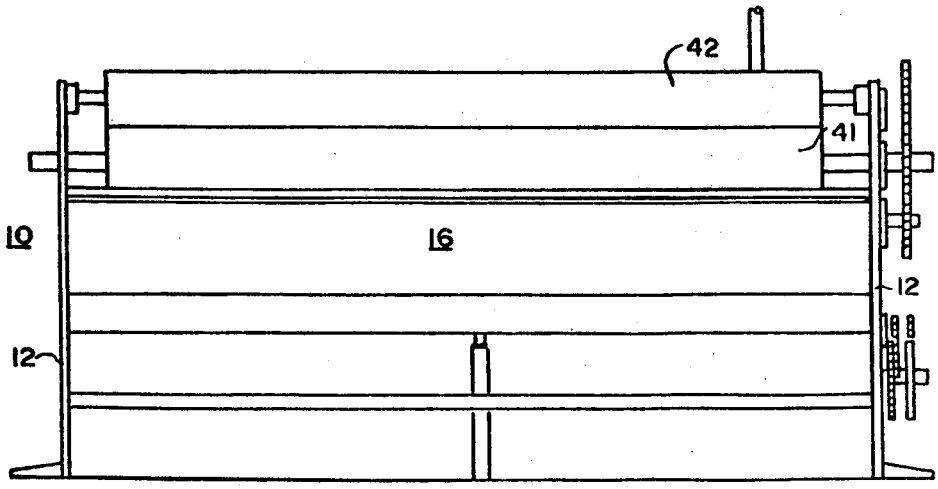
FIG. 7 REAR VIEW

MAT OR RUG CLEANING SYSTEM

This is a division of application Ser. No. 879,042, filed Feb. 21, 1978, entitled "Mat Or Rug Cleaning Process Using Roller Brush" being issued Oct. 7, 1980 as U.S. Pat. No. 4,226,641.

BACKGROUND OF THE INVENTION

1. Field of the Invention

The present invention relates to cleaning machines and more particularly relates to machines for cleaning rugs, mats, and like objects having large surface areas, but being substantially flat and of a flexible nature and the term rug or "mat" is considered herein to include the other, unless otherwise noted.

The present invention relates to cleaning machines and more particularly relates to machines for cleaning rugs, mats, and like objects having large surface areas, but being substantially flat and of a flexible nature.

Even more particularly, the present invention relates to a rug or mat cleaning machine which utilizes a plurality of successive rollers having differential surface speeds thereby creating tucks or creases in the rug to expose the embedded dirt for easy removal by brushes which also form the alternating rollers.

2. General Background and Prior Art

In the cleaning of rugs and mats, such as commercial type mats which are seen in use at the entrance area to large office buildings, in elevators and the like, there is generally provided a washing vessel to which the rugs are added where they can be cleansed much in the manner as a conventional washing machine operates.

However, mats which have a fiber-like surface can easily trap dirt particles deep within even though their overall thickness may be relatively small. The dirt and like particles which are so embedded are difficult to remove. Some prior art devices have attempted to solve the problem of removing dirt and like matter from rugs or mats or similar items which become by the nature of their use quite dirty.

The following table provides a listing of some prior art devices which have been patented:

| Patentee(s) | Prior Art Patents U.S. Pat. Nos. | Issue Date |
|---|---|---|
| H. W. Strassoefer | 821,764 | May 29, 1906 |
| S. Chase, IV | 2,067,752 | August 18, 1934 |
| B. R. Andrews | 2,276,605 | March 17, 1942 |
| C. Mendelson | 2,283,011 | May 12, 1942 |
| Rodman I. Gregg | 3,747,375 | July 24, 1973 |
| Rodman I. Gregg | 3,864,079 | February 4, 1975 |

General Discussion of the Present Invention

The present invention solves the prior art problems and short comings in a simple and inexpensive manner. The present invention provides a cleaning apparatus which is comprised of a plurality of rollers which convey the rug or mat to be cleaned through a cycle which first beats the mat, then washes the mat and thereafter rinses it, and then squeezes the mat to remove extraneous water. In the preferred embodiment there is provided a plurality of feed rollers which grip the mat and convey it at a slower velocity throughout its trip through the machine. Alternating between these feed rollers is a plurality of brush rollers which have a surface velocity substantially higher than the surface velocity of the feed rollers. Thus, a slipping effect is produced between the surface of the brush rollers and the conveying rollers. This slipping effect urges the rug into a tuck or creased position when the rug passes from a brush roller to a feed roller. This differential speed and urging effect creates a crease or bunching up of the rug, the crease or bunching up of the rug preferably occurring in the mat which contains the dirt retaining fiber. Thus, the fiber is flexed to expose the dirt therewithin. At the time the crease exposes the dirt, the crease and dirt are being beaten and cleansed by the roller brushes which are proximately located thereto and are positioned in the washing water. This combination provides an improved cleaning effect which effectively and efficiently cleanses the dirty mats.

In addition pressure belts preferrably are included located above the cleaning brushes to enhance the cleaning action, and, the over-all operation of the machine. The preferred embodiment also includes a special beater roller with projecting axial ridges for initially beating out dust and lint.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 3 is a side schematic view of the rotating elements and sections of the embodiment of FIG. 1; while FIGS. 4 and 5 are likewise side schematic views of selected ones of the roller elements and sections of the embodiment of FIG. 1, showing the two different drive systems for the rotating elements; and FIGS. 6 and 7 are front and rear views, respectively, of the embodiment of FIG. 1.

DETAILED DESCRIPTION OF THE PREFERRED EMBODIMENT

Figure 1:
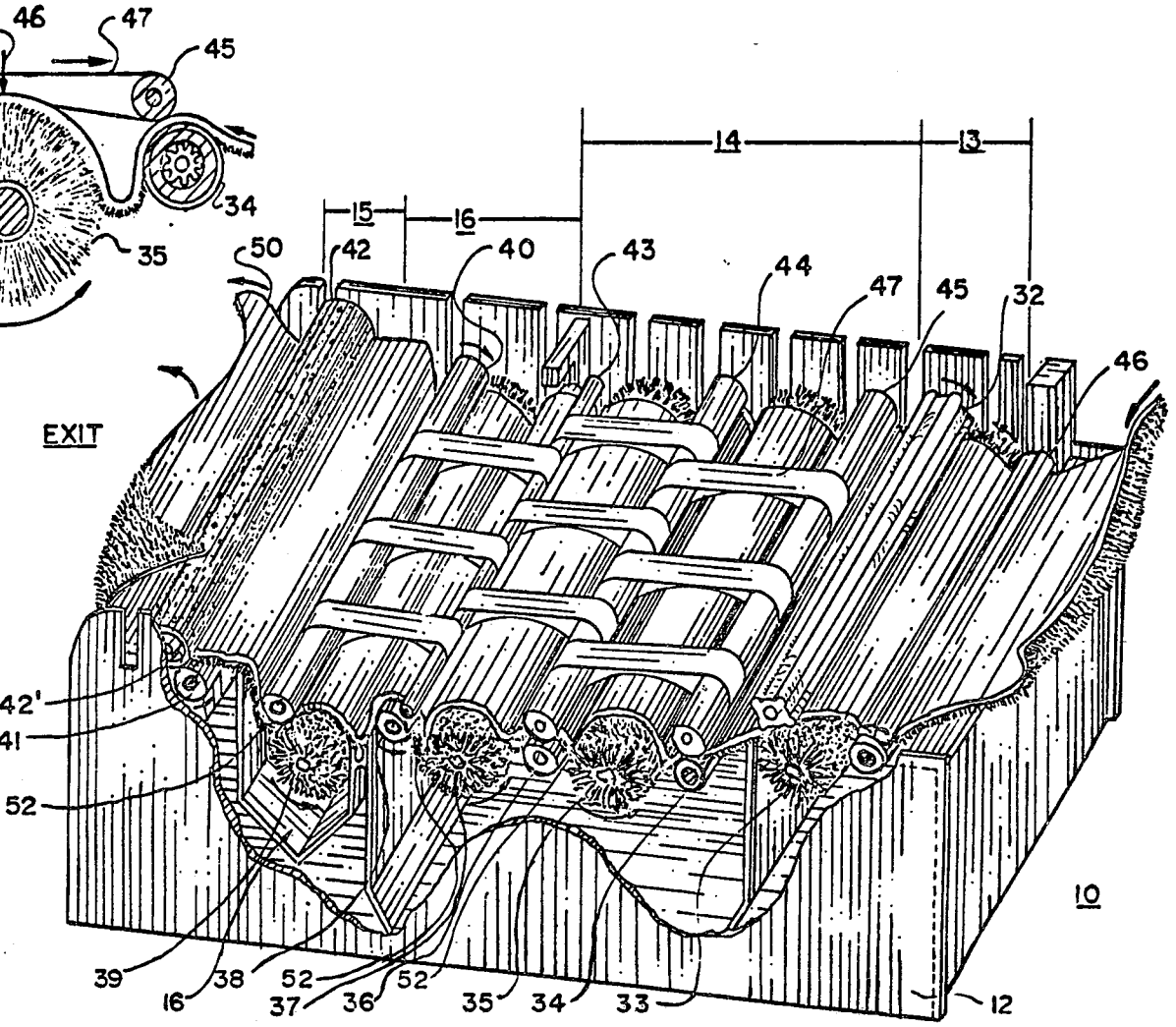
FIG. 1 is a perspective view of the preferred embodiment of the present invention with part of the near wall thereof partially cut away to show some of the internal components.
Figure 2:
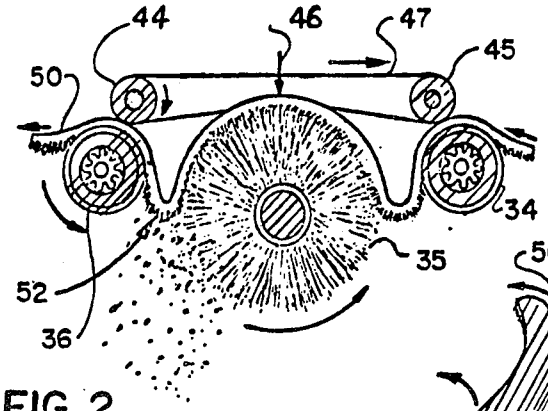
FIG. 2 is a side, close-up of one of the roller brush sections of the embodiment in FIG. 1.
Figure 3:
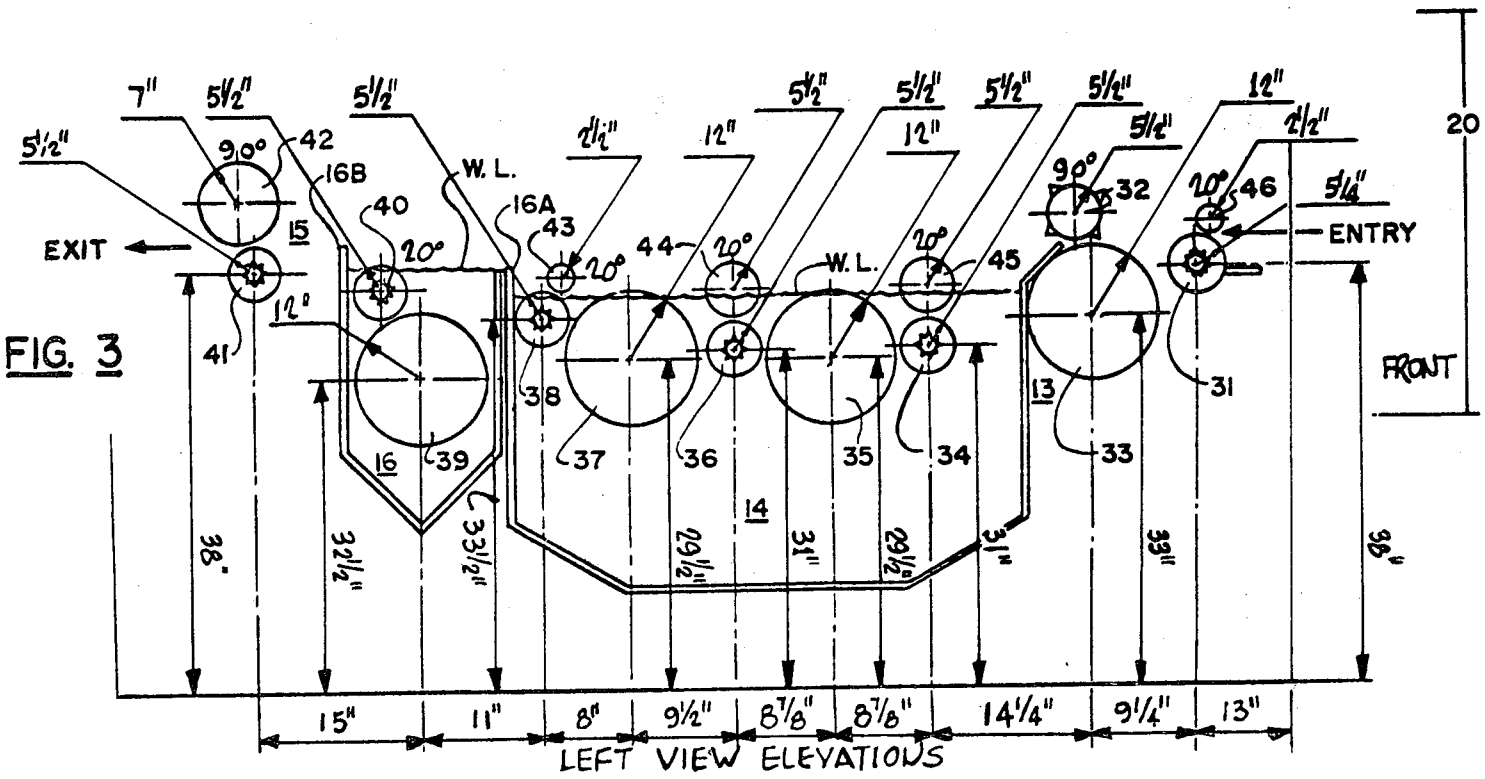

FIGS. 1–7 show the preferred embodiment of the apparatus 10 of the present invention. In FIGS. 1 & 3 there can be seen an overall frame 12 which provides a liquid containing wash and scrubbing section 14 and a rinse section 16.

A conveyance section is designated generally by the numeral 20. Conveyance section 20 is comprised generally of a plurality of rollers 31–46. With reference to FIGS. 1 & 3, the rollers 31–41 are driven, while rollers 42–46 are idler-type rollers having no direct driven power.

The rollers 31–46 shown in FIGS. 1 & 3 are cooperatively arranged to convey a rug 50 through the path shown in FIG. 1. It should be noted in FIG. 1 that a rug will follow a path which produces a tuck designated by the numeral 52 at the points shown in the drawing. The tuck (not FIG. 2) so produced flexes the rug 50 to expose the nap fibers more fully to the cleansing action of the brush rollers 33, 35, 37, and 39. The tuck is produced by the differing speeds of the rollers which will be more fully discussed hereinafter.

Rug 50 begins its trip through the cleaning apparatus 10 of the present invention where it is sandwiched between rollers 31, 46. The indication of rotary travel of rollers 31, 46 is seen in the drawings, with only roller 31 being driven, roller 46 being an idler-type roller which is in surface connection with roller 31 and thus rotates therewith. The surface to surface contact of rollers 31, 46 also produces a non-slip driving means which will urge rug 50 forward at a substantially constant linear speed as is desireable. The speed of rollers 31, 46 will be preset and will urge rug 50 forward at a desired speed which can be varied depending on the type of mat 50 being cleaned, the dirt or like undesireable matter content, and like conditions.

A second set of rollers forming a dry beating section 13 for removing lint and dust is comprised of a beater 32 and a brush roller 33. Both beater 32 and brush 33 have a substantially higher surface speed at their peripheries than rollers 31, 46. However, they are not in face to face contact with one another, but are independently directly driven. Note in FIGS. 1 & 3, the direction of rotation of rollers 32, 33 as is indicated by the curved arrows. Roller 32 is equipped with a plurality of axial, projecting ridges or arms 60 (note FIG. 1) which sequentially hit or abut the upper surface of rug 50, thereby beating out or agitating loose dirt or like undesireable particles contained within the fiber of rug 50. The combination of this beater 32 with brush 33 acts to remove initially particles of dirt from rug 50 while it is still dry. Note that brush roller 33 is provided with a brushing surface which removes the dirt material from the surface of rug 50, which removal is substantially enhanced by the operation of beater 32.

After leaving rollers 32, 33, rug 50 enters wash section 14. Wash section 14 can be filled with any desireable cleaning solution, such as water with a suitable commercial detergent or like cleaner. If desired, the liquid within wash section 14 can be heated to enhance its cleaning properties. However, it is noted that the mechanical cleaning action of the apparatus 10 is so effective that heated water is seldom needed, and hence the present invention serves to conserve energy.

Within wash section 14 there is a first set of conveying rollers 34, 45. Rollers 34, 45 are in close proximity to one another with roller 34 being driven while roller 45 is not independently drive, but rotates in surface to surface contact with roller 34. Roller 45 is thus of an idler nature. However, the close surface to surface abutment of rollers 34, 45 produces a non-slip situation which positively conveys rug 50 forward. This is unlike the contact of rug 50 with the previous rollers 32, 33 which are at a higher rate of speed at their peripheries than the surface of rug 50. Thus, rollers 32, 33 brush against and slip past the surface of rug 50 since its speed through the apparatus 10 is controlled by rollers 31, 46 and rollers 34, 45.

In a like manner, brush roller 35 slips past and abuts against rug 50 as it is at a higher rate of speed and at its periphery than the linear speed of rug 50 as it travels through the apparatus 10. A tuck 52 is produced when the rug travels between brush roller 35 and conveying rollers 36, 44. This tuck is produced by the differing peripheral speeds of rollers 36, 44 which is substantially slower than the peripheral speed of brush 35. The high speed of roller 35 tends to urge rug 50 forward and crowd it about the periphery of drive roller 36 thereby creating a tuck 52 in rug 50. This tuck or bunching up of the rug (note FIG. 2) exposes the fibers of the rug 50 thereby enhancing the removal of dirt therefrom.

Similar to the operation of rollers 31, 46 and rollers 34, 45, rollers 36, 44 are conveying rollers which abut one another in a surface to surface arrangement and thereby control the forward linear speed of rug 50, it being substantially equal to the peripheral speed of rollers 36, 44. In the preferred embodiment, roller 36 is driven, and roller 44 abuts roller 36 in a surface to surface engagement therewith, acting as an idler.

In the preferred embodiment, brush roller 37 acts in combination with conveying roller 38, 43 as was the case with the previous brush roller 35 and the previous conveying rollers 36, 44. This second set of brush rollers in combination with conveying rollers moving at a slower speed produces a second tuck 52 as can be seen from an inspection of FIGS. 1 & 3. This tuck produces a second point where the fibers of rug 50 are flared open and exposed to enhance the removal of dirt as is desireable. In a like manner, conveying rollers 38, 43 are in a surface to surface engagement so that rug 50 will be conveyed therethrough in a positive non-slip manner. As was the case with the previous brush rollers, brush roller 37 rotates at a higher rate of speed and has a higher peripheral speed than the speed of rug 50 as it moves through the apparatus 10. A final tuck 52 is provided in the rinse section 16. In that section there can be seen brush roller 39 which is rotated at a substantially higher rate of speed than feed roller 40, 41, and 42. Rollers 41, 42 are in a face to face, surface to surface abutting relationship, with the roller 41 being driven and roller 42 being an idler type roller. Roller 42, which forms a wringer section 15, can be of a substantial weight to press against and abut roller 41 with some force so as to squeeze rug 50 therebetween and remove excess water therefrom. The roller 42 includes an outer foam rubber layer 42' of for example half inch in thickness to provide a better friction surface.

As illustrated in FIG. 1, a series of upper interdititating belts 47 are provided between the rollers 40–43, 43–44 and 44–45 which press down on the rug 50 against the lower brushes (note direction arrow 48 in FIG. 2), which further enhance the cleaning action of the machine 10. It is further noted that if a rug or mat 50 would get hung up, the upper belts 47 would cause it to merely be run back over the brushes again.

It is noted that exemplary dimensions for the machine 10 and its elements are shown in FIGS. 3 and 4–6 with FIG. 3–7 drawn to scale. Exemplary rotational speeds for the roller elements are approximately twenty-three or twenty-four rpm for the restraining rollers 31, 34, 36, 38 40 and 41; approximately three hundred and eighty rpm for the brushes 33, 35, 37 and 39; and approximately seven hundred rpm for the beater brush 32, it being noted that the four beater elements 60 of beater brush would all hit the rug 50 within about an inch or less of travel of the rug.

As best illustrated in FIG. 3, the wall **16*a* is lower than wall 16*b* of the rinse section 16 which receives a flow of liquid into it, and when the flow of fluid into it creates an overflow, the overflow provides a source of additional wash water into the wash section 14 which is maintained at a lower fluid level (note wavy lines "W.L." indicating the relative water levels). Appropriate drains and fluid inlet lines (generally not illustrated) are included for the wash and rinse sections 14, 16**.

Because many varying and different embodiments may be within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A rug cleaning system, comprising:

a. first rotary feed roller means for conveying the rug to be cleaned;

b. roller brush cleaning means adjacent and substantially parallel to and downstream from said first feed roller means for cleaning the surface of the rug, said roller brush means providing a brushing surface for the rug leaving said first feed roller means; and c. second rotary feed roller means adjacent to and positioned downstream from said roller brush means and receiving the rug being conveyed from said roller brush means for further conveying the rug, said second feed roller means having a peripheral speed slower than the peripheral speed of said brushing surface and conveying the rug at a slower speed than the peripheral speed of said brushing surface to form a tuck in the rug by the differential in the peripheral speeds between said roller brush means and said second feed roller means.

2. The system of claim 1, further comprising wash water vessel means for holding wash water for the rug, said wash water vessel means being located under and at least around said roller brush means, said wash water vessel means being in proximity to the rug when the rug is conveyed through the system, the rug being at least partially wetted by the wash water within said wash water vessel means, the wash water level in said wash water vessel means being up around the top of said roller brush cleaning means during the cleaning of the rug to directly soak, wet and wash the rug where the tuck is formed and the rug is being brushed by the relatively high peripheral speed of said brushing surface.

3. The system of claim 2, wherein said wash water vessel means forms a first, wash section, and wherein there is further included rinse water vessel means located downstream from and adjacent to said wash water vessel means for holding rinse water for rinsing the washed rug, means for conveying the rug proximate said rinse water vessel means, said rinse water vessel means forming a second, rinse section, said rinse section receiving a flow of rinse water thereinto and being in fluid flow communication with said wash section, the flow of rinse water into said rinse section producing an overflow into said wash section, said overflow providing a source of water to said wash section.

4. The system of claim 3, wherein there is provided at least one rotary brush submerged in said rinse section, there being further provided at least one feed roller within said rinse section and arranged cooperatively and substantially parallel to said roller brush.

5. The system of claim 1, wherein said roller brush means is comprised of a plurality of substantially parallel rotary brushes, and said feel roller means is comprised of a plurality of substantially parallel rollers, there being at least one of said rollers adjacent and following each of said rotary brushes, the peripheral speed of each rotary brush being substantially faster than the peripheral speed of each of said rollers, there being created a tuck in the rug when the rug passes from one of said rotary brushes to its corresponding feed roller.

6. The system of claim 5, wherein each of said rollers is comprised of a first and second feed roller, one of said rollers being driven, the other of said rollers being in connective surface contact to the other of said rollers, there being a surface to surface connection between said rollers, the rug being prevented from slipping through said pair of rollers.

7. The system of claim 5, wherein the rotary brushes are positioned to feed the rug through said rollers with its nap side facing the surface of said rotary brushes, the tuck causing the nap side to be opened up for greater exposure of the nap to the brushing action of said rotary brushes.

8. The system of claim 1, wherein there is further included a series of longitudinally extending, upper, flexible belts located above said roller brush means which press the rug downwardly against the roller brush means, enhancing the cleaning action of said brush means.

9. The system of claim 1, wherein there is included a dry beating section located upstream of said roller brush cleaning means and including a rotating, elongated beater having a series of projecting ridges on its peripheral surface for contacting the rug with substantial force as the beater rotates.

10. The system of claim 9, wherein said ridges are axially positioned in parallel array about the periphery of said beater.

11. A rug cleaning system, comprising:

a. first rotary feed roller means for conveying a rug to be cleaned;

b. roller brush cleaning means adjacent and substantially parallel to and downsteam from said first feed roller means for cleaning the surface of the rug;

c. second rotary feed roller means adjacent to and positioned downstream from said roller brush means and receiving the rug being conveyed from said roller brush means for further conveying the rug;

d. wash water vessel means for holding and containing a body of wash water for the rug, said roller brush means being located within said wash water vessel means, said first and second feed roller means serving to convey the rug through only the upper portion of said wash water vessel means and into contact with said roller brush cleaning means, said wash water vessel means providing a water level that is adjacent the rug as it is conveyed through said wash water vessel means, the rug being at partially wetted by the body of wash water that is within said wash water vessel means and brushed by said roller brush cleaning means as said rug is conveyed through said wash water vessel means, said wash water vessel means forming a first, wash section;

e. rinse water vessel means located downsteam from and adjacent to but separated from said wash water vessel means for holding and containing a body of rinse water for rinsing the washed rug, means for conveying said rug through said rinse water vessel means, said rinse water vessel means providing a water level that is at least adjacent the rug as it is conveyed through said rinse water vessel means, said water level in said rinse water vessel means being higher than the water level in said wash water vessel means, said rinse water vessel means forming a second, rinse section, said rinse section receiving a flow of rinse water thereinto and being in over-flow, fluid flow communication with said wash section, the flow of rinse water into said rinse section producing an overflow downwardly into said wash section, said overflow providing a source of wash water to and at the top of said wash section.

12. The system of claim 11, wherein said roller brush means provides a brushing surface with a peripheral speed greater than the speed of the rug leaving said first feed roller means, said second feed roller means conveying the rug at a slower speed than the peripheral speed of said brushing surface, to form a tuck in the rug by the differential in the peripheral speeds between said roller brush means and said feed roller means, the wash water level in said wash water vessel means being up around the top of said roller brush cleaning means during the cleaning of the rug to directly soak, wet and wash the rug where the tuck is formed and the rug is being brushed by the relatively high peripheral speed of said brushing surface.

* * * * *